US006855680B2

(12) United States Patent
Smerznak et al.

(10) Patent No.: US 6,855,680 B2
(45) Date of Patent: Feb. 15, 2005

(54) STABILIZED LIQUID COMPOSITIONS

(75) Inventors: Mark Allen Smerznak, Brussels (BE); Walter August Maria Broeckx, Berlare (BE)

(73) Assignee: The Procter & Gamble Company, Cincinnati, OH (US)

( * ) Notice: Subject to any disclaimer, the term of this patent is extended or adjusted under 35 U.S.C. 154(b) by 225 days.

(21) Appl. No.: 10/003,946

(22) Filed: Oct. 23, 2001

(65) Prior Publication Data

US 2002/0160928 A1 Oct. 31, 2002

Related U.S. Application Data

(60) Provisional application No. 60/243,824, filed on Oct. 27, 2000, and provisional application No. 60/291,679, filed on May 17, 2001.

(51) Int. Cl.[7] ..... C11D 3/12; C11D 3/395

(52) U.S. Cl. ..... 510/321; 510/340; 510/356; 510/350

(58) Field of Search ..... 510/321, 340, 510/350, 356, 306, 376, 312, 307, 446, 224; 8/137, 111; 252/186.38

(56) References Cited

U.S. PATENT DOCUMENTS

| | | | | |
|---|---|---|---|---|
| 5,340,390 | A | 8/1994 | Magauran et al. | |
| 5,885,948 | A * | 3/1999 | Glenn et al. | 510/130 |
| 6,040,282 | A | 3/2000 | Guskey et al. | |
| 6,043,300 | A | 3/2000 | Santhanam | |
| 6,080,708 | A | 6/2000 | Glenn, Jr. et al. | |
| 6,183,757 | B1 * | 2/2001 | Beerse et al. | 424/401 |
| 6,241,976 | B1 * | 6/2001 | Esser et al. | 424/65 |

FOREIGN PATENT DOCUMENTS

| | | |
|---|---|---|
| EP | 0 623 670 A2 | 11/1994 |
| EP | 0 887 071 A1 | 12/1998 |
| WO | WO 99/38489 | 8/1999 |

* cited by examiner

*Primary Examiner*—Gregory Webb
(74) *Attorney, Agent, or Firm*—Armina E. Matthews; Jeffrey V. Bamber; Brahm J. Corstanje

(57) ABSTRACT

Structuring systems, specifically thread-like structuring systems and/or disk-like structuring systems wherein structuring agents aggregate together to form disk-like structures that can interact with other disk-like structures to result in a structuring system, and processes for making such structuring systems, stabilized liquid compositions comprising such structuring systems, systems that utilize such structuring systems for stabilizing liquid compositions, and methods for utilizing the stabilized liquid compositions to provide a benefit, are disclosed.

17 Claims, No Drawings

STABILIZED LIQUID COMPOSITIONS

CROSS-REFERENCE TO RELATED CASES

This application claims the benefit of the filing dates of provisional U.S. Patent Application Ser. No. 60/243,824, filed Oct. 27, 2000 and Ser. No. 60/291,679, filed May 17, 2001.

FIELD OF THE INVENTION

The present invention relates to structuring systems, specifically thread-like structuring systems and/or non-thread-like structuring systems (i.e., disk-like structuring systems wherein structuring agents aggregate together to form disk-like structures that can interact with other disk-like structures to result in a structuring system), and processes for making such structuring systems, stabilized liquid compositions comprising such structuring systems, systems that utilize such structuring systems for stabilizing liquid compositions, and methods for utilizing the stabilized liquid compositions to provide a benefit.

BACKGROUND OF THE INVENTION

Liquid compositions, especially heavy duty liquid compositions, more specifically aqueous heavy duty liquid compositions have traditionally been problematic to form and maintain because often times the materials desired to be incorporated into the liquid compositions have a tendency to separate from the aqueous phase and/or coalesce.

U.S. Pat. Nos. 5,340,390 and 6,043,300 disclose organic and/or non-aqueous liquid systems, such as paints, inks, that are stabilized by a castor-oil derivative. These references fail to teach that aqueous liquid compositions can be stabilized by a castor-oil derivative.

U.S. Pat. Nos. 6,080,708 and 6,040,282 disclose personal care and/or shampoo compositions that are stabilized by a stabilizer, such as a crystalline, hydroxyl-containing stabilizer.

There is a continuing need for stabilizer liquid compositions, especially stabilized heavy duty liquid compositions, more specifically stabilized aqueous heavy duty liquid compositions; systems for stabilizing such compositions; and methods for utilizing such compositions to provide a benefit.

SUMMARY OF THE INVENTION

The present invention fulfills the need described above by providing structuring systems (i.e., thread-like structuring systems and/or non-thread-like structuring systems) that can stabilize liquid compositions, especially water-containing liquid compositions, more specifically water-containing detergent liquid compositions. Accordingly, the present invention provides structuring systems and processes for making such structuring systems wherein the structuring systems can be incorporated into water-containing liquid compositions, for example water-containing laundry and/or dishwashing liquid compositions to stabilize ingredients within the liquid compositions.

In one aspect of the present invention, a water-containing laundry and/or dishwashing liquid composition comprising a structuring system, preferably a thread-like structuring system, in accordance with the present invention is provided.

In another aspect of the present invention, a water-containing laundry and/or dishwashing liquid composition comprising a fabric substantive agent, a crystalline, hydroxyl-containing agent, water and a detergent adjunct selected from the group consisting of: is provided.

In still another aspect of the present invention, a water-containing laundry and/or dishwashing liquid composition comprising an benefit agent and a structuring system, preferably a thread-like structuring system, in accordance with the present invention such that the unstable agent is stabilized, preferably in a manner such that the benefit agent provides its benefit upon use of the liquid composition, within the liquid composition is provided.

In still yet another aspect of the present invention, a water-containing liquid detergent composition comprising:

a) a fabric substantive agent having limited solubility in said liquid detergent composition;

b) a crystalline, hydroxyl-containing stabilizer; and optionally, c) a nonsurfactant adjunct suitable for laundry or dishwashing detergents wherein said adjunct is soluble in said liquid detergent composition is provided.

In another aspect of the present invention, a method for treating an environment, preferably a surface in need of treatment or an aqueous medium, comprising contacting the environment with a liquid composition in accordance with the present invention is provided.

In still another aspect of the present invention, a stabilizing system wherein an aqueous laundry and/or dishwashing liquid composition is stabilized by an effective amount of a structuring system, preferably a thread-like structuring system and/or a combination of thread-like structuring system and non-thread-like structuring system, in accordance with the present invention is provided.

In another embodiment, a water-containing liquid detergent composition comprising:

a) a defoaming and/or aesthetic agent having limited solubility in said liquid detergent composition;

b) a crystalline, hydroxyl-containing stabilizer; and optionally, c) a nonsurfactant adjunct suitable for laundry or dishwashing detergents wherein said adjunct is soluble in said liquid detergent composition is provided.

In yet another embodiment, an aqueous, heavy-duty laundry detergent comprising:

at least 5% water, preferably at least 20% water;

5% to 40% of a surfactant system comprising anionic, nonionic or mixed anionic/nonionic surfactants, optionally including amine oxides;

from 0.1% to 5% of a crystalline, hydroxyl-containing stabilizer;

from at least about 0.01% to about 5% of detersive enzymes;

from 0.1% to 10% of a fabric-substantive agent selected from silicones having all of a cationically charged moiety, a silicon-containing moiety and a polyoxyalkylene moiety; said composition having a pH at 1% in water of at least 7.5 is provided.

In still yet another embodiment, a method for increasing the viscosity of an an aqueous laundry and/or dishwashing liquid composition comprising the step of adding an effective amount of a structuring system, preferably a thread-like structuring system or a combination of thread-like structuring system and non-thread-like structuring system, to the liquid composition such that the viscosity of the liquid composition is increased compared to the viscosity of the liquid composition without such a structuring system.

Accordingly, the present invention provides structuring systems, processes for making such structuring systems, compositions using such structuring systems to stabilize unstable ingredients, methods for utilizing such stabilized compositions and systems that utilize such structuring systems for stabilizing liquid compositions.

These and other objects, features and advantages will be clear from the following detailed description, examples and appended claims.

All percentages, ratios and proportions herein are on a weight basis based on a neat product unless otherwise indicated. All documents cited herein are hereby incorporated by reference.

DETAILED DESCRIPTION

Definitions

The physical form of the structuring system depends upon the process for making the structuring system, especially the crystallization process. The crystallization process may be controlled to result in one or more specific physical forms, such as thread-like structures and/or non-thread-structures.

"Thread-like Structuring System" (i.e., in the form of threads and/or fibers) as used herein means one or more agents that are capable of providing a chemical network that reduces the tendency of materials with which they are combined to coalesce and/or phase split. Examples of the one or more agents include crystalline, hydroxyl-containing stabilizing agents and/or hydrogenated jojoba. Surfactants are not included within the thread-like structuring system. Without wishing to be bound by theory, it is believed that the thread-like structuring system forms a fibrous or entangled threadlike network in-situ on cooling of the matrix. The thread-like structuring system has an average aspect ratio of from about 1.5:1, preferably from at least 10:1, to about 200:1.

The thread-like structuring system can be made to have a viscosity of 2000 cps or less at an intermediate shear range (5 s-1 to 50 s-1) which allows for the pouring of the detergent out of a standard bottle, while the low shear viscosity of the product at 0.1 s-1 is at least 2000 cps but more preferably greater than 20,000 cps.

The thread-like structuring system of the present invention provides the liquid compositions of the present invention improved shelf and stress stability, but allow the liquid compositions to permit its benefit-providing agents to provide their benefits upon use.

"Non-thread-like Structuring System" (i.e., in the form of spheres, discs, and/or platelets) as used herein means one or more agents that are capable of providing a chemical network, especially when present in combination with a thread-like structuring system, that reduces the tendency of materials with which they are combined to coalesce and/or phase split. Examples of the one or more agents include crystalline, hydroxyl-containing stabilizing agents and/or hydrogenated jojoba. Surfactants are not included within the non-thread-like structuring system. Without wishing to be bound by theory, it is believed that the non-thread-like structuring system forms a network in-situ on cooling of the matrix. The non-thread-like structuring system has an average aspect ratio of from less than about 5:1, preferably less than about 2:1 to about 1:1. The non-thread-like structures in the non-thread-like structuring system typically have an average particle size of from about 20 microns, preferably from about 10 microns to about 1 micron. "System" as used herein means a complex unity formed of many often, but not always, diverse parts (i.e., materials, compositions, devices, appliances, procedures, methods, conditions, etc.) subject to a common plan or serving a common purpose.

"Limited solubility" as used herein means that no more than nine tenths of the formulated agent actually dissolves in the liquid composition "Soluble" as used herein means that more than nine tenths of the formulated agent actually dissolves in the liquid composition.

Processes for Making the Structuring System

A. Process for Making the Thread-Like Structuring System

The process for making the thread-like structuring system of the present invention comprises heating a mixture of water and a crystalline, hydroxyl-containing stabilizing agent to above the melting point of the crystalline, hydroxyl-containing stabilizing agent, and then cooling the mixture while mixing continuously to room temperature such that a thread-like structuring system is formed.

In one embodiment, the process comprises activating the crystalline, hydroxyl-containing stabilizing agent comprising the steps of: 1) combining the crystalline, hydroxyl-stabilizing agent, preferably from about 0.1% to about 5% by weight of the premix, with water, preferably at least 20% by weight of the premix, and a surfactant and optionally, a salt, to form a premix; 2) heating the premix formed in Step 1) above the melting point of the crystalline, hydroxyl-containing stabilizing agent; and 3) cooling the mixture formed in Step 2) while agitating the mixture to ambient temperature such that a thread-like structuring system is formed.

The premix formed in Step 1) may further comprise a surfactant.

The premix formed in Step 1) may further comprise an amine oxide.

Further detail around this process of making the thread-like structuring system can be found in U.S. Pat. No. 6,080,708, which is owned by The Procter and Gamble Company.

B. Process for Making the Non-Thread-Like Structuring System

Non-thread-like structuring systems may be made by the process described above for the thread-like structuring systems.

Crystalline, Hydroxyl-containing Stabilizing Agent

The crystalline, hydroxyl-containing stabilizing agent typically is present in the liquid compositions of the present invention at a level of from about 0.1% to about 10%, more typically from about 0.1% to about 3%, most typically from about 0.3% to about 2% by weight of the liquid composition.

Crystalline, hydroxyl-containing stabilizing agents can be fatty acid, fatty ester or fatty soap water-insoluble wax-like substance.

The crystalline, hydroxyl-containing stabilizing agents in accordance with the present invention are preferably derivatives of castor oil, especially hydrogenated castor oil derivatives. For example, castor wax.

The crystalline, hydroxyl-containing agent typically is selected from the group consisting of:

i)

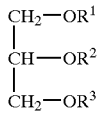

wherein:

$R^1$ is $-\overset{O}{\overset{\|}{C}}-R^4$;

$R^2$ is $R^1$ or H;

$R^3$ is $R^1$ or H;

$R^4$ is independently $C_{10}$–$C_{22}$ alkyl or alkenyl comprising at least one hydroxyl group;

ii)

$R^7-\overset{O}{\overset{\|}{C}}-OM$ wherein:

$R^7$ is $-\overset{O}{\overset{\|}{C}}-R^4$;

$R^4$ is as defined above in i);

M is $Na^+$, $K^+$, $Mg^{++}$ or $Al^{3+}$, or H; and iii) mixtures thereof

Alternatively, the crystalline, hydroxyl-containing stabilizing agent may have the formula:

$$\begin{array}{l} CH_2-\overset{O}{\overset{\|}{C}}O-(CH_2)_x-\overset{OH}{\overset{|}{C}H}-(CH_2)_a-CH_3 \\ | \\ CH-\overset{O}{\overset{\|}{C}}O-(CH_2)_y-\overset{OH}{\overset{|}{C}H}-(CH_2)_b-CH_3 \\ | \\ CH_2-\underset{O}{\underset{\|}{C}}O-(CH_2)_z-\overset{OH}{\overset{|}{C}H}-(CH_2)_c-CH_3 \end{array}$$

wherein:

(x+a) is from between 11 and 17; (y+b) is from between 11 and 17; and (z+c) is from between 11 and 17. Preferably, wherein x=y=z=10 and/or wherein a=b=c=5.

Commercially available crystalline, hydroxyl-containing stabilizing agents include THIXCIN® from Rheox, Inc.

In addition to THIXCIN®, alternative materials that are suitable for use as crystalline, hydroxyl-containing stabilizing agents include, but are not limited to, compounds of the formula:

$$Z-(CH(OH))a-Z'$$

where a is from 2 to 4, preferably 2; Z and Z' are hydrophobic groups, especially selected from C6–C20 alkyl or cycloalkyl, C6–C24 alkaryl or aralkyl, C6–C20 aryl or mixtures thereof. Optionally Z can contain one or more nonpolar oxygen atoms as in ethers or esters.

A nonlimiting example of such alternative materials is 1,4-di-O-benzyl-D-Threitol in the R,R, and S,S forms and any mixtures, optically active or not.

Limited Solubility Agents

The limited solubility agents that need to be stabilized within liquid compositions include agents that have a tendency to phase separate and/or coalesce in the liquid compositions. Nonlimiting examples include limited solubility agents include fabric substantive agents. Examples of fabric substantive agents include silicon-containing agents, such as cationic silicones, nitrogen-containing silicones, such as TUBINGAL® commercially available from Th Goldshmidt, preferably polydimethyl siloxanes; fabric substantive perfume agents; anti-abrasion agents, such as carboxymethylcellulose and ethylmethylcellulose; dye fixative agents; optical brighteners; and soil release polymers.

The limited solubility agents are typically present in the liquid compositions of the present invention from about 0.001% to about 20%, more typically from 0.1% to about 8%, most typically from about 0.5% to about 6% by weight of the liquid composition.

a. Silicon-Containing Agents

Nonlimiting examples of useful silicones in the composition of the present invention include noncurable silicones such as polydimethylsilicone and volatile silicones, and curable silicones such as aminosilicones, phenylsilicones and hydroxysilicones. The word "silicone" as used herein preferably refers to emulsified silicones, including those that are commercially available and those that are emulsified in the composition, unless otherwise described. Preferably, the silicones are hydrophobic; are neither irritating, toxic, nor otherwise harmful when applied to fabric or when they come in contact with human skin; are chemically stable under normal use and storage conditions; and are capable of being deposited on fabric.

Silicones that are useful in the liquid compositions of the present invention include polyalkyl and/or phenylsilicones silicone fluids and gums with the following structure:

$$A-Si(R_2)-O-[Si(R_2)-O-]_{q-Si(R2)}-A$$

The alkyl groups substituted on the siloxane chain (R) or at the ends of the siloxane chains (A) can have any structure as long as the resulting silicones remain fluid at room temperature.

Each R group preferably can be alkyl, aryl, hydroxy, or hydroxyalkyl group, and mixtures thereof, more preferably, each R is methyl, ethyl, propyl or phenyl group, most preferably R is methyl. Each A group which blocks the ends of the silicone chain can be hydrogen, methyl, methoxy, ethoxy, hydroxy, propoxy, and aryloxy group, preferably methyl. Suitable A groups include hydrogen, methyl, methoxy, ethoxy, hydroxy, and propoxy. q is preferably an integer from about 7 to about 8,000. The preferred silicones are polydimethyl siloxanes; more preferred silicones are polydimethyl siloxanes having a viscosity of from about 50 to about 1000,000 centistokes at 25° C. Suitable examples include silicones commercially available from Dow Corning Corporation and General Electric Company.

Other useful silicone materials include materials of the formula:

$$HO-[Si(CH_3)_2-O]_x-\{Si(OH)[(CH_2)_3-NH-(CH_2)_2-NH_2]O\}y-H$$

wherein x and y are integers which depend on the molecular weight of the silicone, preferably having a viscosity of from about 10,000 cst to about 500,000 cst at 25° C. This material is also known as "amodimethicone". Although silicones with a high number, e.g., greater than about 0.5 millimolar equivalent of amine groups can be used, they are not preferred because they can cause fabric yellowing.

Similarly, silicone materials which can be used correspond to the formulas:

$$(R^1)_aG_{3-a}-Si-(-OSiG_2)_n-(OSiG_b(R^1)_{2-b})_m-O-SiG_{3-a}(R^1)_a$$

wherein G is selected from the group consisting of hydrogen, phenyl, OH, and/or $C_1$–$C_8$ alkyl; a denotes 0 or an integer from 1 to 3; b denotes 0 or 1; the sum of n+m is a number from 1 to about 2,000; $R^1$ is a monovalent radical of formula $C_pH_{2p}L$ in which p is an integer from 2 to 8 and L is selected from the group consisting of:

$N(R^2)CH_2—CH_2—N(R^2)_2$;

$N(R^2)_2$;

$N^+(R^2)_3A^-$; and $N^+(R^2)CH_2—CH_2N^+H_2A^-$ wherein each $R^2$ is chosen from the group consisting of hydrogen, phenyl, benzyl, saturated hydrocarbon radical, and each $A^-$ denotes compatible anion, e.g., a halide ion; and $$R^3—N^+(CH_3)_2—Z—[Si(CH_3)_2O]_f—Si(CH_3)_2—Z—N^+(CH_3)_2—R^3.2CH_3COO^-$$

wherein $Z=—CH_2—CH(OH)—CH_2O—CH_2)_3—$ $R^3$ denotes a long chain alkyl group; and f denotes an integer of at least about 2.

In the formulas herein, each definition is applied individually and averages are included.

Another silicone material which can be used has the formula:

$$(CH_3)_3Si—[O—Si(CH_3)_2]_n—\{OSi(CH_3)[(CH_2)_3—NH—(CH_2)_2—NH_2]\}_m—Si(CH_3)_3$$

wherein n and m are the same as before. The preferred silicones of this type are those which do not cause fabric discoloration.

Alternatively, the silicone material can be provided as a moiety or a part of a oligosaccharide molecule. These materials provide a lubricity benefit in addition to the expected fabric care benefits. Other examples of dual function silicone materials useful in the present invention are adjunct shape retention copolymers having siloxane macromers grafted thereto. The non-silicone backbone of such polymers should have a molecular weight of from about 5,000 to about 1,000,000, and the polymer should have a glass transition temperature (Tg), i.e., the temperature at which the polymer changes from a brittle vitreous state to a plastic state, of greater than about −20° C. Adjunct fabric shape retention silicone-containing polymers useful in the present invention are described in more detailed herein below along with other adjunct shape retention polymers.

The silicone can be either a polydimethyl siloxane (polydimethyl silicone or PDMS), or a derivative thereof, e.g., amino silicones, ethoxylated silicones, amino functionalized polydimethyl siloxanes, etc.

Silicone derivatives such as amino-functional silicones, quaternized silicones, and silicone derivatives containing Si—OH, Si—H, and/or Si—Cl bonds, can be used.

Cationic silicones of the present invention are preferably cationic silicone polymers comprising one or more polydimethylsiloxane units and one or more quaternary nitrogen moieties.

Preferably one or more of the quaternary nitrogen moieties are present in the backbone of the cationic silicone polymer.

The quaternary nitrogen moieties can be positioned within the backbone of the polymer as "end cap" and/or "integrated" quaternary nitrogen moieties. In one preferred embodiment, the cationic silicone polymer of the present invention comprises quaternary nitrogen moieties as end caps. In another preferred embodiment, the cationic silicone polymer of the present invention comprises only one end cap quaternary nitrogen moiety and one or more other integrated quaternary nitrogen moieties. In yet another preferred embodiment, the cationic silicone polymer comprises only integrated quaternary nitrogen moieties.

In one preferred embodiment, the cationic silicone polymer (Structure 1) has the formula:

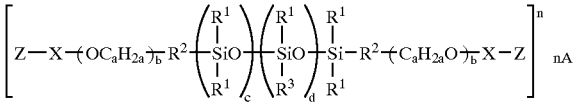

wherein:

$R^1$ is independently selected from the group consisting of: $C_{1-22}$ alkyl; $C_{2-22}$ alkenyl; $C_{6-22}$ alkylaryl groups and mixtures thereof;

$R^2$ is independently selected from the group consisting of: divalent organic moieties that may contain one or more oxygen atoms;

X is independently selected from the group consisting of ring-opened epoxides;

$R^3$ is independently selected from polyether groups having the formula:

$$—M^1(C_aH_{2a}O)_b—M^2$$

wherein $M^1$ is a divalent hydrocarbon residue; $M^2$ is H, $C_{1-22}$ alkyl, $C_{2-22}$ alkenyl, $C_{6-22}$ alkylaryl, $C_{1-22}$ hydroxyalkyl, polyalkyleneoxide or (poly)alkoxy alkyl groups;

Z is independently selected from the group consisting of monovalent organic moieties comprising at least one quaternized nitrogen atom, preferably Z is independently selected from the group consisting of:

(i)

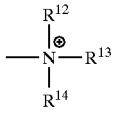

(ii)

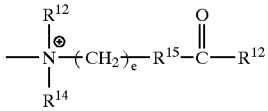

(iii)

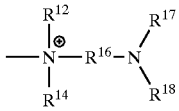

(iv)

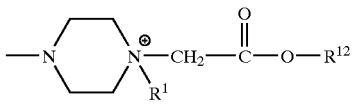

(v) monovalent aromatic or aliphatic heterocylic group, substituted or unsubstituted, containing at least one quarternized nitrogen atom;

wherein:

$R^4$, $R^5$ and $R^6$ are the same or different, and are selected from the group consisting of: $C_{1-22}$ alkyl; $C_{2-22}$ alkenyl; $C_{6-22}$ alkylaryl; $C_{1-22}$ hydroxyalkyl; polyalkyleneoxide; (poly)alkoxy alkyl groups and mixtures thereof;

$R^7$ is —O— or $NR^{11}$;

$R^8$ and $M^1$ are the same or different divalent hydrocarbon residues;

$R^9$, $R^{10}$, $R^{11}$ and $M^2$ are independently selected from the group consisting of: H, $C_{1-22}$ alkyl; $C_{2-22}$ alkenyl; $C_{6-22}$ alkylaryl; $C_{1-22}$ hydroxyalkyl; polyalkyleneoxide; (poly)alkoxy alkyl groups and mixtures thereof; and e is from 1–6;

a is from 2–4;

b is from 0–100;

c is from 1–1000, preferably greater than 20, more preferably greater than 30, even more preferably greater than 50, preferably less than 500, more preferably less than 300, even more preferably less than 200, most preferably from about 70 to about 100;

d is from 0–100;

n is the number of positive charges associated with the cationic silicone polymer, which is greater than or equal to 2; and A is a monovalent anion, in other words, a suitable counterion.

A commercially available cationic silicone polymer is TUBINGAL 3474, which is commercially available from Th. Goldschmidt.

In the above structures, the ring open epoxides may be aliphatic, cycloaliphatic, and may contain aromatic rings. They also may contain hydroxy groups and/or an ether linkage. Preferably, the ring opened epoxides are selected from the group consisting of:

i) $—CH_2CH(OH)(CH_2)_vCH(OH)CH_2—$;

ii) $—CH(CH_2OH)(CH_2)_vCH(CH_2OH)—$;

iii) $—CH_2CH(OH)(CH_2)_vCH(CH_2[OH])—$;

iv) $—(CH_2)_vOCH_2CH(OH)CH_2—$; and v) $—(CH_2)_vOCH_2CH(CH_2[OH])—$;

wherein v is from 2 to 6.

Alternatively, the ring opened epoxides may be derived from the following: epoxycyclohexyl alkylene groups; ω-(3,4-epoxycyclohexyl)-β-methylethylene and β-(3,4-epoxy-4-methylcyclohexyl)-β-methylethylene. Additional examples of suitable ring opened epoxides are described in EP 1 000 959 and WO 97/32917.

Nonlimiting examples of suitable aliphatic heterocyclic groups are described in Thomas L. Gilchrist's *Heterocyclic Chemistry,* 3rd Edition, 386, 1992, Longman.

b. Fabric Substantive Perfumes

Fabric substantive perfumes include products of the reaction between a primary and/or secondary amine and one or more active ingredients.

The primary and/or secondary amine is preferably selected from the group consisting of aminoaryl derivatives, polyamines, amino acids and derivatives, substituted amines and amides, glucamines, dendrimers, amino-substituted mono-, di-, oligo-, poly-saccharides and mixtures thereof.

The one or more active ingredients which are reacted with the primary and/or secondary amine is preferably selected from the group consisting of aldehydes, ketones and mixtures thereof.

The reaction product preferably has an Odor Intensity Index of less than that of a 1% solution of methylanthranilate in dipropylene glycol, a Dry Surface Odor Index of more than 5. Preferably the reaction product is not an aminostyrene.

The fabric substantive perfumes typically have a formula selected from the group consisting of: 1) $B—(NH_2)_n$; 2) $B—(NH)_n$; and 3) $B—(NH)_n—(NH)_n$ wherein B is a carrier material which is preferably an organic carrier (inorganic carriers being less preferred), more preferably the carrier material is an amino functionalized polydialkylsiloxane.

WO 00/02991 describes such fabric substantive perfumes in more detail.

c. Anti-abrasion Agents

Cellulosic based polymer or oligomer materials are suitable for use in the liquid compositions of the present invention. Nonlimiting examples of such materials include carboxymethylcellulose (CMC) and ethylmethylcellulose (EMC). A preferred cellulosic based polymer has the formula:

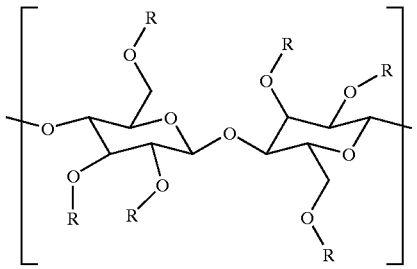

;

wherein each R is selected from the group consisting of $R_2$, $R_C$, and

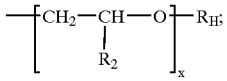

wherein:

each $R_2$ is independently selected from the group consisting of H and $C_1$–$C_4$ alkyl;

each $R_C$ is

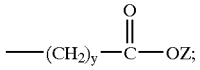

wherein each Z is independently selected from the group consisting of M, $R_2$, $R_C$, and $R_H$;

each $R_H$ is independently selected from the group consisting of $C_5$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $C_1$–$C_{20}$ alkoxy-2-hydroxyalkyl, $C_7$–$C_{20}$ alkylaryloxy-2-hydroxyalkyl, $(R_4)_2N$-alkyl, $(R_4)_2N$-2-hydroxyalkyl, $(R_4)_3$ N-alkyl, $(R_4)_3$ N-2-hydroxyalkyl, $C_6$–$C_{12}$ aryloxy-2-hydroxyalkyl,

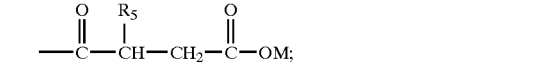

each $R_4$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, aminoalkyl, alkylaminoalkyl, dialkylaminoalkyl, piperidinoalkyl, morpholinoalkyl, cycloalkylaminoalkyl and hydroxyalkyl;

each $R_5$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $(R_4)_2N$-alkyl, and $(R_4)_3$ N-alkyl;

wherein:

M is a suitable cation selected from the group consisting of Na, K, 1/2Ca, and 1/2Mg;

each x is from 0 to about 5;

each y is from about 1 to about 5; and provided that:

the Degree of Substitution for group $R_H$ is between about 0.001 and 0.1, more preferably between about 0.005 and 0.05, and most preferably between about 0.01 and 0.05;

the Degree of Substitution for group $R_C$ wherein Z is H or M is between about 0.2 and 2.0, more preferably between about 0.3 and 1.0, and most preferably between about 0.4 and 0.7;

if any $R_H$ bears a positive charge, it is balanced by a suitable anion; and two $R_4$'s on the same nitrogen can together form a ring structure selected from the group consisting of piperidine and morpholine.

Another preferred anti-abrasion agent has the formula:

I

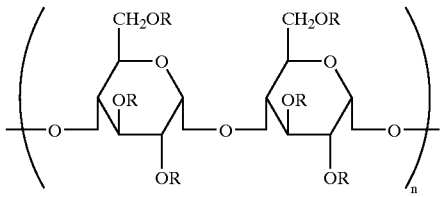

or

II

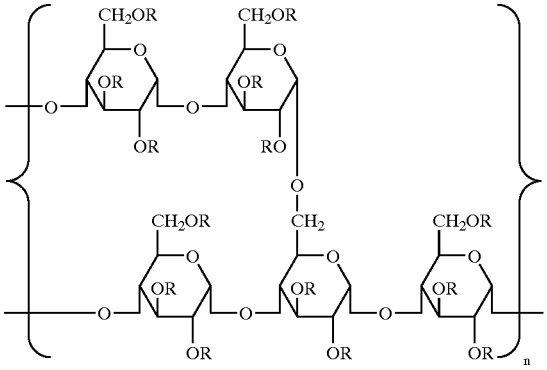

wherein each R is selected from the group consisting of $R_2$, $R_C$, and

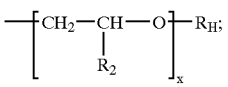

wherein:

each $R_2$ is independently selected from the group consisting of H and $C_1$–$C_4$ alkyl;

each $R_C$ is

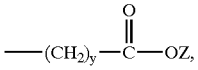

wherein each Z is independently selected from the group consisting of M, $R_2$, $R_C$, and $R_H$;

each $R_H$ is independently selected from the group consisting of $C_5$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $C_1$–$C_{20}$ alkoxy-2-hydroxyalkyl, $C_7$—$C_{20}$ alkylaryloxy-2-hydroxyalkyl, $(R_4)_2$N-alkyl, $(R_4)_2$N-2-hydroxyalkyl, $(R_4)_3$ N-alkyl, $(R_4)_3$ N-2-hydroxyalkyl, $C_6$–$C_{12}$ aryloxy-2-hydroxyalkyl,

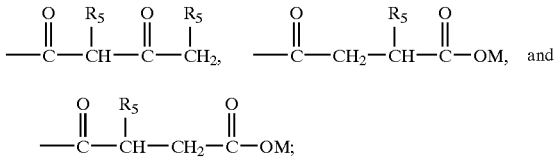

each $R_4$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, aminoalkyl, alkylaminoalkyl, dialkylaminoalkyl, piperidinoalkyl, morpholinoalkyl, cycloalkylaminoalkyl and hydroxyalkyl;

each $R_5$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $(R_4)_2$N-alkyl, and $(R_4)_3$ N-alkyl;

wherein:

M is a suitable cation selected from the group consisting of $Na^+$, $K^+$, $1/2Ca^{2+}$, $1/2Mg^{2+}$, or $^+NH_jR_k$ wherein j and k are independently from 0 to 4 and wherein j+k is 4 and R in this formula is any moiety capable of forming a cation, preferably methyl and/or ethyl group or derivative;

each x is from 0 to about 5;

each y is from about 1 to about 5; and provided that:

the Degree of Substitution for group $R_H$ is between about 0.001 and about 0.1, more preferably between about 0.005 and about 0.05, and most preferably between about 0.01 and about 0.05;

the Degree of Substitution for group $R_C$ wherein Z is H or M is between about 0 and about 2.0, more preferably between about 0.05 and about 1.0, and most preferably between about 0.1 and about 0.5;

if any $R_H$ bears a positive charge, it is balanced by a suitable anion; and two $R_4$'s on the same nitrogen can together form a ring structure selected from the group consisting of piperidine and morpholine.

The "Degree of Substitution" for group $R_H$, which is sometimes abbreviated herein "$DS_{RH}$", means the number of moles of group $R_H$ components that are substituted per anhydrous glucose unit, wherein an anhydrous glucose unit is a six membered ring as shown in the repeating unit of the general structure above.

The "Degree of Substitution" for group $R_C$, which is sometimes abbreviated herein "$DS_{RC}$", means the number of moles of group $R_C$ components, wherein Z is H or M, that are substituted per anhydrous D-glucose unit, wherein an anhydrous D-glucose unit is a six membered ring as shown in the repeating unit of the general structures above. It is understood that in addition to the required number of $R_C$ components wherein Z is H or M, there can be, and most preferably are, additional $R_C$ components wherein Z is a group other than H or M.

Another preferred anti-abrasion agent has the formula:

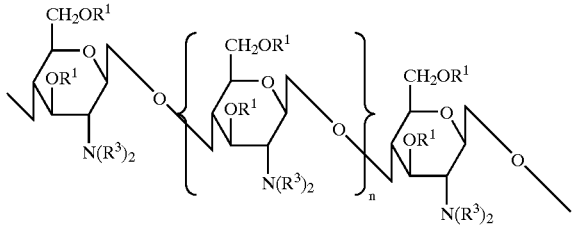

wherein each $R^1$ is selected from the group consisting of $R_2$, $R_C$, and

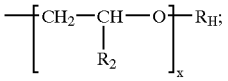

wherein:

each $R_2$ is independently selected from the group consisting of H and $C_1$–$C_4$ alkyl;

each $R_C$ is

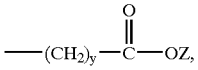

wherein each Z is independently selected from the group consisting of M, $R_2$, $R_C$, and $R_H$;

each $R_H$ is independently selected from the group consisting of $C_5$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $C_1$–$C_{20}$ alkoxy-2-hydroxyalkyl, $C_7$–$C_{20}$ alkylaryloxy-2-hydroxyalkyl, $(R_4)_2$N-alkyl, $(R_4)_2$N-2-hydroxyalkyl, $(R_4)_3$ N-alkyl, $(R_4)_3$ N-2-hydroxyalkyl, $C_6$-$C_{12}$ aryloxy-2-hydroxyalkyl,

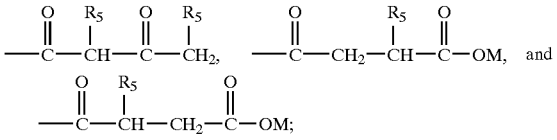

each $R_4$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, aminoalkyl, alkylaminoalkyl, dialkylaminoalkyl, piperidinoalkyl, morpholinoalkyl, cycloalkylaminoalkyl and hydroxyalkyl;

each $R_5$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $(R_4)_2$N-alkyl, and $(R_4)_3$ N-alkyl;

wherein:

each $R^3$ is independently and individually selected from the group consisting of: H, $C(O)CH_3$, $R^1$ and mixtures thereof; preferably at least one $R^3$on each nitrogen is not $R_c$ where y is 1 and Z is H (in other words, preferably the chitosan is not a N,N-biscarboxymethylated chitosan);

M is a suitable cation selected from the group consisting of $Na^+$, $K^+$, $1/2Ca^{2+}$, $1/2Mg^{2+}$, or $^+NH_jR_k$ wherein j and k are independently from 0 to 4 and wherein j+k is 4 and R in this formula is any moiety capable of forming a cation, preferably methyl and/or ethyl group or derivative;

each x is from 0 to about 5;

each y is from about 1 to about 5; and provided that:

the Degree of Substitution for group $R_H$ is between about 0 and about 0.1, more preferably between about 0.005 and about 0.05, and most preferably between about 0.01 and about 0.05;

the Degree of Substitution for group $R_C$ wherein Z is H or M is between 0, preferably about 0.05 and about 1.5, more preferably between about 0.1 and about 1.0, and most preferably between about 0.3 and about 0.7;

if any $R_H$ bears a positive charge, it is balanced by a suitable anion; and two $R_4$'s on the same nitrogen can together form a ring structure selected from the group consisting of piperidine and morpholine.

d. Dye Fixative Agents

Cationic Dye Fixing Agents—The compositions of the present invention optionally comprise from about 0.001%, preferably from about 0.5% to about 90%, preferably to about 50%, more preferably to about 10%, most preferably to about 5% by weight, of one or more dye fixing agents.

Dye fixing agents, or "fixatives", are well-known, commercially available materials which are designed to improve the appearance of dyed fabrics by minimizing the loss of dye from fabrics due to washing. Not included within this definition are components which can in some embodiments serve as fabric softener actives.

Many dye fixing agents are cationic, and are based on quaternized nitrogen compound or on nitrogen compounds having a strong cationic charge which is formed in situ under the conditions of usage. Cationic fixatives are available under various trade names from several suppliers. Representative examples include: CROSCOLOR PMF (July 1981, Code No. 7894) and CROSCOLOR NOFF (January 1988, Code No. 8544) ex Crosfield; INDOSOL E-50 (Feb. 27, 1984, Ref. No. 6008.35.84; polyethyleneamine-based) ex Sandoz; SANDOFIX TPS, ex Sandoz, is a preferred dye fixative for use herein. Additional non-limiting examples include SANDOFIX SWE (a cationic resinous compound) ex Sandoz, REWIN SRF, REWIN SRF-O and REWIN DWR ex CHT-Beitlich GMBH; Tinofix® ECO, Tinofix® FRD and Solfin® ex Ciba-Geigy and described in WO 99/14301. A preferred dye fixing agent for use in the compositions of the present invention is CARTAFIX CB® ex Clariant.

Other cationic dye fixing agents are described in "After-treatments for Improving the Fastness of Dyes on Textile Fibres", Christopher C. Cook, *Rev. Prog. Coloration,* Vol. XII, (1982). Dye fixing agents suitable for use in the present invention are ammonium compounds such as fatty acid-diamine condensates inter alia the hydrochloride, acetate, metosulphate and benzyl hydrochloride salts of diamine esters. Non-limiting examples include oleyldiethyl aminoethylamide, oleylmethyl diethylenediamine methosulphate, monostearylethylene diaminotrimethylammonium methosulphate. In addition, the N-oxides of tertiary amines; derivatives of polymeric alkyldiamines, polyamine-cyanuric chloride condensates, and aminated glycerol dichlorohydrins are suitable for use as dye fixatives in the compositions of the present invention.

Cellulose Reactive Dye Fixing Agents—Another dye fixing agent suitable for use in the present invention are cellulose reactive dye fixing agents. The compositions of the present invention optionally comprise from about 0.01%, preferably from about 0.05%, more preferably from about 0.5% to about 50%, preferably to about 25%, more preferably to about 10% by weight, most preferably to about 5% by weight, of one or more cellulose reactive dye fixing agents. The cellulose reactive dye fixatives may be suitably combined with one or more dye fixatives described herein above in order to comprise a "dye fixative system".

The term "cellulose reactive dye fixing agent" is defined herein as "a dye fixative agent which reacts with the cellulose fibers upon application of heat or upon a heat treatment either in situ or by the formulator".

Typically cellulose reactive dye fixing agents are compounds which contain a cellulose reactive moiety, non limiting examples of these compounds include halogenotriazines, vinyl sulphones, epichlorhydrine derivatives, hydroxyethylene urea derivatives, formaldehyde condensation products, polycarboxylates, glyoxal and glutaraldehyde derivatives, and mixtures thereof. Further examples can be found in "Textile Processing and Properties", Tyrone L. Vigo, at page 120 to 121, Elsevier (1997), which discloses specific electrophilic groups and their corresponding cellulose affinity.

Preferred hydroxyethylene urea derivatives include dimethyloldihydroxyethylene, urea, and dimethyl urea glyoxal. Preferred formaldehyde condensation products include the condensation products derived from formaldehyde and a group selected from an amino-group, an imino-group, a phenol group, an urea group, a cyanamide group and an aromatic group. Commercially available compounds among this class are Sandofix WE 56 ex Clariant, Zetex E ex Zeneca and Levogen BF ex Bayer. Preferred polycarboxylates derivatives include butane tetracarboxilic acid derivatives, citric acid derivatives, polyacrylates and derivatives thereof. A most preferred cellulosic reactive dye fixing agents is one of the hydroxyethylene urea derivatives class commercialized under the tradename of Indosol CR ex Clariant. Still other most preferred cellulosic reactive dye fixing agents are commercialized under the tradename Rewin DWR and Rewin WBS ex CHT R. Beitlich.

e. Optical Brighteners

Any optical brighteners or other brightening or whitening agents known in the art can be incorporated at levels typically from about 0.01% to about 1.2%, by weight, into the detergent compositions herein. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Artic White CC and Artic White CWD, the 2-(4-styryl-phenyl)-2H-naptho[1,2-d]triazoles; 4,4'-bis-(1,2,3-triazol-2-yl)-stilbenes; 4,4'-bis(styryl) bisphenyls; and the amino-coumarins. Specific examples of these brighteners include 4-methyl-7-diethyl-amino coumarin; 1,2-bis(benzimidazol-2-yl)ethylene; 1,3-diphenyl-pyrazolines; 2,5-bis(benzoxazol-2-yl)thiophene; 2-styryl-naptho[1,2-d]oxazole; and 2-(stilben4-yl)-2H-naphtho[1,2-d]triazole. See also U.S. Pat. No. 3,646,015, issued Feb. 29, 1972 to Hamilton.

f. Soil Release Agents

Soil release agents—The compositions according to the present invention may optionally comprise one or more soil release agents including anti-redeposition agents. If utilized, soil release agents will generally comprise from about 0.01%, preferably from about 0.1%, more preferably from about 0.2% to about 10%, preferably to about 5%, more preferably to about 3% by weight, of the composition.

Any soil suspending polyamine polymer known to those skilled in the art may be used herein. Particularly suitable polyamine polymers for use herein are polyalkoxylated polyamines.

The most highly preferred polyamines for use herein are the so-called ethoxylated polyethylene amines, i.e., the polymerized reaction product of ethylene oxide with ethyleneimine, having the general formula:

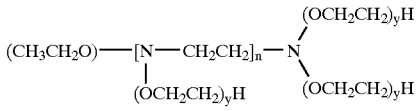

when y=2–30. Particularly preferred for use herein is an ethoxylated polyethylene amine, in particular ethoxylated tetraethylenepentamine, and quaternized ethoxylated hexamethylene diamine.

Soil suspending polyamine polymers contribute to the benefits of the present invention, i.e., that when added on top of said diacyl peroxide, further improve the stain removal performance of a composition comprising them, especially under laundry pretreatment conditions, as described herein. Indeed, they allow to improve the stain removal performance on a variety of stains including greasy stains, enzymatic stains, clay/mud stains as well as on bleachable stains.

Typically, the compositions comprise up to 10% by weight of the total composition of such a soil suspending polyamine polymer or mixtures thereof, preferably from 0.1% to 5% and more preferably from 0.3% to 2%.

The compositions herein may also comprise other polymeric soil release agents known to those skilled in the art. Such polymeric soil release agents are characterised by having both hydrophilic segments, to hydrophilize the surface of hydrophobic fibres, such as polyester and nylon, and hydrophobic segments, to deposit upon hydrophobic fibres and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–$C_6$ alkylene segments, or mixtures therein, (iii) poly(vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from about 1 to about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents useful in the present invention also include cellulosic derivatives such as hydroxyether cellulosic polymers, co-polymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterised by poly(vinyl ester) hydrophobe segments include graft co-polymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN type of material, e.g., SOKALAN HP-22, available from BASF (West Germany).

One type of preferred soil release agent is a co-polymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another preferred polymeric soil release agent is a polyester with repeat units of ethylene terephthalate units which contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from Dupont) and MILEASE T (from ICI). See also U.S. Pat. No. 4,702,857, issued Oct. 27, 1987 to Gosselink.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are fully described in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Preferred polymeric soil release agents also include the soil release agents of U.S. Pat. No. 4,877,896, issued Oct. 31, 1989 to Maldonado et al, which discloses anionic, especially sulfoaroyl, end-capped terephthalate esters.

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate. Said soil release agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof. See U.S. Pat. No. 5,415,807, issued May 16, 1995, to Gosselink et al.

Nonlimiting examples of suitable soil release polymers are disclosed in: U.S. Pat. Nos. 5,728,671; 5,691,298; 5,599,782; 5,415,807; 5,182,043; 4,956,447; 4,976,879; 4,968,451; 4,925,577; 4,861,512; 4,877,896; 4,771,730; 4,711,730; 4,721,580; 4,000,093; 3,959,230; and 3,893,929; and European Patent Application 0 219 048.

Further suitable soil release agents are described in U.S. Pat. Nos. 4,201,824; 4,240,918; 4,525,524; 4,579,681; 4,220,918; and 4,787,989; EP 279,134 A; EP 457,205 A; and DE 2,335,044.

If utilised, soil release agents will generally comprise from 0.01% to 10.0%, by weight, of the compositions herein, typically from 0.1% to 5%, preferably from 0.2% to 3.0%.

g. Bleaching Systems

Bleaching Agents—Hydrogen peroxide sources are described in detail in the herein incorporated Kirk Othmer's Encyclopedia of Chemical Technology, 4th Ed (1992, John Wiley & Sons), Vol. 4, pp. 271–300 "Bleaching Agents (Survey)", and include the various forms of sodium perborate and sodium percarbonate, including various coated and modified forms.

The preferred source of hydrogen peroxide used herein can be any convenient source, including hydrogen peroxide itself. For example, perborate, e.g., sodium perborate (any hydrate but preferably the mono- or tetra-hydrate), sodium carbonate peroxyhydrate or equivalent percarbonate salts, sodium pyrophosphate peroxyhydrate, urea peroxyhydrate, or sodium peroxide can be used herein. Also useful are sources of available oxygen such as persulfate bleach (e.g., OXONE, manufactured by DuPont). Sodium perborate monohydrate and sodium percarbonate are particularly preferred. Mixtures of any convenient hydrogen peroxide sources can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with a silicate, borate or water-soluble surfactants. Percarbonate is available from various commercial sources such as FMC, Solvay and Tokai Denka.

Compositions of the present invention may also comprise as the bleaching agent a chlorine-type bleaching material. Such agents are well known in the art, and include for example sodium dichloroisocyanurate ("NaDCC"). However, chlorine-type bleaches are less preferred for compositions which comprise enzymes.

(a) Bleach Activators—Preferably, the peroxygen bleach component in the composition is formulated with an activator (peracid precursor). The activator is present at levels of from about 0.01%, preferably from about 0.5%, more preferably from about 1% to about 15%, preferably to about 10%, more preferably to about 8%, by weight of the composition. Preferred activators are selected from the group consisting of tetraacetyl ethylene diamine (TAED), benzoylcaprolactam (BzCL), 4-nitrobenzoylcaprolactam, 3-chlorobenzoylcaprolactam, benzoyloxybenzenesulphonate (BOBS), nonanoyloxybenzenesulphonate (NOBS), phenyl benzoate (PhBz), decanoyloxybenzenesulphonate ($C_{10}$-OBS), benzoylvalerolactam (BZVL), octanoyloxybenzenesulphonate ($C_8$-OBS), perhydrolyzable esters and mixtures thereof, most preferably benzoylcaprolactam and benzoylvalerolactam. Particularly preferred bleach activators in the pH range from about 8 to about 9.5 are those selected having an OBS or VL leaving group.

Preferred hydrophobic bleach activators include, but are not limited to, nonanoyloxybenzenesulphonate (NOBS), 4-[N-(nonaoyl) amino hexanoyloxy]-benzene sulfonate sodium salt (NACA-OBS) an example of which is described in U.S. Pat. No. 5,523,434, dodecanoyloxybenzenesulphonate (LOBS or $C_{12}$-OBS), 10-undecenoyloxybenzenesulfonate (UDOBS or $C_{11}$-OBS with unsaturation in the 10 position), and decanoyloxybenzoic acid (DOBA).

Preferred bleach activators are those described in U.S. Pat. No. 5,698,504 Christie et al., issued Dec. 16, 1997; U.S. Pat. No. 5,695,679 Christie et al. issued Dec. 9, 1997; U.S. Pat. No. 5,686,401 Willey et al., issued Nov. 11, 1997; U.S. Pat. No. 5,686,014 Hartshorn et al., issued Nov. 11, 1997; U.S. Pat. No. 5,405,412 Willey et al., issued Apr. 11, 1995; U.S. Pat. No. 5,405,413 Willey et al., issued Apr. 11, 1995; U.S. Pat. No. 5,130,045 Mitchel et al., issued Jul. 14, 1992; and U.S. Pat. No. 4,412,934 Chung et al., issued Nov. 1, 1983, and copending patent applications U.S. Ser. Nos. 08/709,072, 08/064,564, all of which are incorporated herein by reference.

The mole ratio of peroxygen bleaching compound (as AvO) to bleach activator in the present invention generally ranges from at least 1:1, preferably from about 20:1, more preferably from about 10:1 to about 1:1, preferably to about 3:1.

Quaternary substituted bleach activators may also be included. The present laundry compositions preferably comprise a quaternary substituted bleach activator (QSBA) or a quaternary substituted peracid (QSP); more preferably, the former. Preferred QSBA structures are further described in U.S. Pat. No. 5,686,015 Willey et al., issued Nov. 11, 1997; U.S. Pat. No. 5,654,421 Taylor et al., issued Aug. 5, 1997; U.S. Pat. No. 5,460,747 Gosselink et al., issued Oct. 24, 1995; U.S. Pat. No. 5,584,888 Miracle et al., issued Dec. 17, 1996; and U.S. Pat. No. 5,578,136 Taylor et al., issued Nov. 26, 1996; all of which are incorporated herein by reference.

Highly preferred bleach activators useful herein are amide-substituted as described in U.S. Pat. No. 5,698,504, U.S. Pat. No. 5,695,679, and U.S. Pat. No. 5,686,014 each of which are cited herein above. Preferred examples of such bleach activators include: (6-octanamidocaproyl) oxybenzenesulfonate, (6-nonanamidocaproyl) oxybenzenesulfonate, (6-decanamidocaproyl) oxybenzenesulfonate and mixtures thereof.

Other useful activators, disclosed in U.S. Pat. No. 5,698,504, U.S. Pat. No. 5,695,679, U.S. Pat. No. 5,686,014 each of which is cited herein above and U.S. Pat. No. 4,966,723 Hodge et al., issued Oct. 30, 1990, include benzoxazin-type activators, such as a $C_6H_4$ ring to which is fused in the 1,2-positions a moiety —C(O)OC($R^1$)═N—.

Depending on the activator and precise application, good bleaching results can be obtained from bleaching systems having with in-use pH of from about 6 to about 13, preferably from about 9.0 to about 10.5. Typically, for example, activators with electron-withdrawing moieties are used for near-neutral or sub-neutral pH ranges. Alkalis and buffering agents can be used to secure such pH.

Acyl lactam activators, as described in U.S. Pat. No. 5,698,504, U.S. Pat. No. 5,695,679 and U.S. Pat. No. 5,686,014, each of which is cited herein above, are very useful herein, especially the acyl caprolactams (see for example WO 94-28102 A) and acyl valerolactams (see U.S. Pat. No. 5,503,639 Willey et al., issued Apr. 2, 1996 incorporated herein by reference).

(b) Organic Peroxides, especially Diacyl Peroxides—These are extensively illustrated in Kirk Othmer, Encyclopedia of Chemical Technology, Vol. 17, John Wiley and Sons, 1982 at pages 27–90 and especially at pages 63–72, all incorporated herein by reference. If a diacyl peroxide is used, it will preferably be one which exerts minimal adverse impact on spotting/filming.

(c) Metal-containing Bleach Catalysts—The present invention compositions and methods may utilize metal-containing bleach catalysts that are effective for use in bleaching compositions. Preferred are manganese and cobalt-containing bleach catalysts.

One type of metal-containing bleach catalyst is a catalyst system comprising a transition metal cation of defined bleach catalytic activity, such as copper, iron, titanium, ruthenium tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra (methylenephosphonic acid) and water-soluble salts thereof. Such catalysts are disclosed in U.S. Pat. No. 4,430,243 Bragg, issued Feb. 2, 1982.

Manganese Metal Complexes—If desired, the compositions herein can be catalyzed by means of a manganese compound. Such compounds and levels of use are well known in the art and include, for example, the manganese-based catalysts disclosed in U.S. Pat. Nos. 5,576,282; 5,246,621; 5,244,594; 5,194,416; and 5,114,606; and European Pat. App. Pub. Nos. 549,271 A1, 549,272 A1, 544,440 A2, and 544,490 A1; Preferred examples of these catalysts include $Mn^{IV}_2(u\text{-}O)_3$(1,4,7-trimethyl-1,4,7-triazacyclononane)$_2(PF_6)_2$, $Mn^{III}_2(u\text{-}O)_1(u\text{-}OAc)_2$(1,4,7-trimethyl-1,4,7-triazacyclononane)$_2(ClO_4)_2$, $Mn^{IV}_4(u\text{-}O)_6$(1,4,7-triazacyclononane)$_4(ClO_4)_4$, $Mn^{III}Mn^{IV}_4(u\text{-}O)_1$(u-

$OAc)_2$-(1,4,7-trimethyl-1,4,7-triazacyclononane)$_2(ClO_4)_3$, $Mn^{IV}$(1,4,7-trimethyl-1,4,7-triazacyclononane)-$(OCH_3)_3(PF_6)$, and mixtures thereof. Other metal-based bleach catalysts include those disclosed in U.S. Pat. Nos. 4,430,243 and 5,114,611. The use of manganese with various complex ligands to enhance bleaching is also reported in the following: U.S. Pat. Nos. 4,728,455; 5,284,944; 5,246,612; 5,256,779; 5,280,117; 5,274,147; 5,153,161; and 5,227,084.

Cobalt Metal Complexes—Cobalt bleach catalysts useful herein are known, and are described, for example, in U.S. Pat. Nos. 5,597,936; 5,595,967; and 5,703,030; and M. L. Tobe, "Base Hydrolysis of Transition-Metal Complexes", *Adv. Inorg. Bioinorg. Mech.,* (1983), 2, pages 1–94. The most preferred cobalt catalyst useful herein are cobalt pentaamine acetate salts having the formula $[Co(NH_3)_5OAc]T_y$, wherein "OAc" represents an acetate moiety and "$T_y$" is an anion, and especially cobalt pentaamine acetate chloride, $[Co(NH_3)_5OAc]Cl_2$; as well as $[Co(NH_3)_5OAc](OAc)_2$; $[Co(NH_3)_5OAc](PF_6)_2$; $[Co(NH_3)_5OAc](SO_4)$; $[Co(NH_3)_5OAc](BF_4)_2$; and $[Co(NH_3)_5OAc](NO_3)_2$ (herein "PAC").

These cobalt catalysts are readily prepared by known procedures, such as taught for example in U.S. Pat. Nos. 5,597,936; 5,595,967; and 5,703,030; in the Tobe article and the references cited therein; and in U.S. Pat. No. 4,810,410; *J. Chem. Ed.* (1989), 66 (12), 1043–45; The Synthesis and Characterization of Inorganic Compounds, W. L. Jolly (Prentice-Hall; 1970), pp. 461–3; *Inorg. Chem.,* 18, 1497–1502 (1979); *Inorg. Chem.,* 21, 2881–2885 (1982); *Inorg. Chem.,* 18, 2023–2025 (1979); Inorg. Synthesis, 173–176 (1960); and *Journal of Physical Chemistry,* 56, 22–25 (1952).

Transition Metal Complexes of Macropolycyclic Rigid Ligands—Compositions herein may also suitably include as bleach catalyst a transition metal complex of a macropolycyclic rigid ligand. The phrase "macropolycyclic rigid ligand" is sometimes abbreviated as "MRL" in discussion below. The amount used is a catalytically effective amount, suitably about 1 ppb or more, for example up to about 99.9%, more typically about 0.001 ppm or more, preferably from about 0.05 ppm to about 500 ppm (wherein "ppb" denotes parts per billion by weight and "ppm" denotes parts per million by weight).

Suitable transition metals e.g., Mn are illustrated hereinafter. "Macropolycyclic" means a MRL is both a macrocycle and is polycyclic. "Polycyclic" means at least bicyclic. The term "rigid" as used herein includes "having a superstructure" and "cross-bridged". "Rigid" has been defined as the constrained converse of flexibility: see D. H. Busch., *Chemical Reviews.,* (1993), 93, 847–860, incorporated by reference. More particularly, "rigid" as used herein means that the MRL must be determinably more rigid than a macrocycle ("parent macrocycle") which is otherwise identical (having the same ring size and type and number of atoms in the main ring) but lacking a superstructure (especially linking moieties or, preferably cross-bridging moieties) found in the MRL's. In determining the comparative rigidity of macrocycles with and without superstructures, the practitioner will use the free form (not the metal-bound form) of the macrocycles. Rigidity is well-known to be useful in comparing macrocycles; suitable tools for determining, measuring or comparing rigidity include computational methods (see, for example, Zimmer, *Chemical Reviews.* (1995), 95(38), 2629–2648 or Hancock et al., *Inorganica Chimica Acta.* (1989), 164, 73–84.

Preferred MRL's herein are a special type of ultra-rigid ligand which is cross-bridged. A "cross-bridge" is nonlimitingly illustrated in 1.11 hereinbelow. In 1.11, the cross-bridge is a —$CH_2CH_2$— moiety. It bridges $N^1$ and $N^8$ in the illustrative structure. By comparison, a "same-side" bridge, for example if one were to be introduced across $N^1$ and $N^{12}$ in 1.11, would not be sufficient to constitute a "cross-bridge" and accordingly would not be preferred.

Suitable metals in the rigid ligand complexes include Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV). Preferred transition-metals in the instant transition-metal bleach catalyst include manganese, iron and chromium.

More generally, the MRL's (and the corresponding transition-metal catalysts) herein suitably comprise:

(a) at least one macrocycle main ring comprising four or more heteroatoms; and (b) a covalently connected non-metal superstructure capable of increasing the rigidity of the macrocycle, preferably selected from (i) a bridging superstructure, such as a linking moiety;

(ii) a cross-bridging superstructure, such as a cross-bridging linking moiety; and (iii) combinations thereof.

The term "superstructure" is used herein as defined in the literature by Busch et al., see, for example, articles by Busch in "Chemical Reviews".

Preferred superstructures herein not only enhance the rigidity of the parent macrocycle, but also favor folding of the macrocycle so that it co-ordinates to a metal in a cleft. Suitable superstructures can be remarkably simple, for example a linking moiety such as any of those illustrated in FIG. 1 and FIG. 2 below, can be used.

Fig, 1

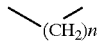

wherein n is an integer, for example from 2 to 8, preferably less than 6, typically 2 to 4, or

Fig. 2

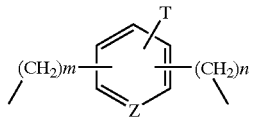

wherein m and n are integers from about 1 to 8, more preferably from 1 to 3; Z is N or CH; and T is a compatible substituent, for example H, alkyl, trialkylammonium, halogen, nitro, sulfonate, or the like. The aromatic ring in 1.10 can be replaced by a saturated ring, in which the atom in Z connecting into the ring can contain N, O, S or C.

Suitable MRL's are further nonlimitingly illustrated by the following compound:

Fig. 3

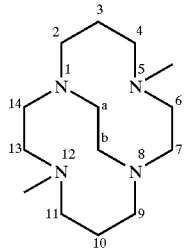

This is a MRL in accordance with the invention which is a highly preferred, cross-bridged, methyl-substituted (all nitrogen atoms tertiary) derivative of cyclam. Formally, this ligand is named 5,12-dimethyl-1,5,8,12-tetraazabicyclo[6.6.2]hexadecane using the extended von Baeyer system. See "A Guide to IUPAC Nomenclature of Organic Compounds: Recommendations 1993", R. Panico, W. H. Powell and J-C Richer (Eds.), Blackwell Scientific Publications, Boston, 1993; see especially section R-2.4.2.1.

Transition-metal bleach catalysts of Macrocyclic Rigid Ligands which are suitable for use in the invention compositions can in general include known compounds where they conform with the definition herein, as well as, more preferably, any of a large number of novel compounds expressly designed for the present laundry or laundry uses, and non-limitingly illustrated by any of the following:

Dichloro-5,12-dimethyl-1,5,8,12-tetraazabicyclo[6.6.2] hexadecane Manganese(II)

Diaquo-5,12-dimethyl-1,5,8,12-tetraazabicyclo[6.6.2] hexadecaneManganese(II) Hexafluorophosphate Aquo-hydroxy-5,12-dimethyl-1,5,8,12-tetraazabicyclo [6.6.2]hexadecane Manganese(III) Hexafluorophosphate Diaquo-5,12-dimethyl-1,5,8,12-tetraazabicyclo[6.6.2] hexadecaneManganese(II) Tetrafluoroborate Dichloro-5,12-dimethyl-1,5,8,12-tetraazabicyclo[6.6.2] hexadecaneManganese(III) Hexafluorophosphate Dichloro-5,12-di-n-butyl-1,5,8,12-tetraaza bicyclo[6.6.2] hexadecaneManganese(II)

Dichloro-5,12-dibenzyl-1,5,8,12-tetraazabicyclo[6.6.2] hexadecaneManganese(II)

Dichloro-5-n-butyl-12-methyl-1,5,8,12-tetraaza-bicyclo [6.6.2]hexadecane Manganese(II)

Dichloro-5-n-octyl-12-methyl-1,5,8,12-tetraaza-bicyclo [6.6.2]hexadecane Manganese(II)

Dichloro-5-n-butyl-12-methyl-1,5,8,12-tetraaza-bicyclo [6.6.2]hexadecane Manganese(II).

As a practical matter, and not by way of limitation, the compositions and laundry processes herein can be adjusted to provide on the order of at least one part per hundred million of the active bleach catalyst species in the aqueous washing medium, and will preferably provide from about 0.01 ppm to about 25 ppm, more preferably from about 0.05 ppm to about 10 ppm, and most preferably from about 0.1 ppm to about 5 ppm, of the bleach catalyst species in the wash liquor. In order to obtain such levels in the wash liquor of an automatic washing process, typical compositions herein will comprise from about 0.0005% to about 0.2%, more preferably from about 0.004% to about 0.08%, of bleach catalyst, especially manganese or cobalt catalysts, by weight of the bleaching compositions.

(d) Other Bleach Catalysts—The compositions herein may comprise one or more other bleach catalysts. Preferred bleach catalysts are zwitterionic bleach catalysts, which are described in U.S. Pat. No. 5,576,282 (especially 3-(3,4-dihydroisoquinolinium)propane sulfonate) and U.S. Pat. No. 5,817,614. Other bleach catalysts include cationic bleach catalysts are described in U.S. Pat. Nos. 5,360,569, 5,442,066, 5,478,357, 5,370,826, 5,482,515, 5,550,256, and WO 95/13351, WO 95/13352, and WO 95/13353.

(e) Pre-formed Peroxy Carboxylic acid—The liquid compositions of the present invention may comprise a pre-formed peroxycarboxylic acid (hereinafter referred to as a "peracid"). Any suitable peracid compound known in the art can be used herein.

The preformed peracid compound as used herein is any convenient compound which is stable and which under consumer use conditions provides an effective amount of peracid anion. The preformed peracid compound preferably is selected from the group consisting of percarboxylic acids and salts, percarbonic acids and salts, perimidic acids and salts, peroxymonosulfuric acids and salts, and mixtures thereof.

One class of suitable organic peroxycarboxylic acids have the general formula:

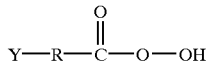

wherein R is an alkylene or substituted alkylene group containing from 1 to about 22 carbon atoms or a phenylene or substituted phenylene group, and Y is hydrogen, halogen, alkyl, aryl, —C(O)OH or —C(O)OOH.

Organic peroxyacids suitable for use in the present invention can contain either one or two peroxy groups and can be either aliphatic or aromatic. When the organic peroxycarboxylic acid is aliphatic, the unsubstituted acid has the general formula:

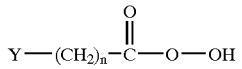

where Y can be, for example, H, $CH_3$, $CH_2Cl$, C(O)OH, or C(O)OOH; and n is an integer from 1 to 20. When the organic peroxycarboxylic acid is aromatic, the unsubstituted acid has the general formula:

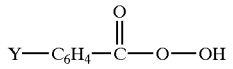

wherein Y can be, for example, hydrogen, alkyl, alkylhalogen, halogen, C(O)OH or C(O)OOH.

Typical monoperoxy acids useful herein include alkyl and aryl peroxyacids such as:

(i) peroxybenzoic acid and ring-substituted peroxybenzoic acid, e.g. peroxy-a-naphthoic acid, monoperoxyphthalic acid (magnesium salt hexahydrate), and o-carboxybenzamidoperoxyhexanoic acid (sodium salt);

(ii) aliphatic, substituted aliphatic and arylalkyl monoperoxy acids, e.g. peroxylauric acid, peroxystearic acid, N-nonanoylaminoperoxycaproic acid (NAPCA), N,N-(3-octylsuccinoyl)aminoperoxycaproic acid (SAPA) and N,N-phthaloylaminoperoxycaproic acid (PAP);

(iii) amidoperoxyacids, e.g. monononylamide of either peroxysuccinic acid (NAPSA) or of peroxyadipic acid (NAPAA).

Typical diperoxyacids useful herein include alkyl diperoxyacids and aryldiperoxyacids, such as:

(iv) 1,12-diperoxydodecanedioic acid;

(v) 1,9-diperoxyazelaic acid;

(vi) diperoxybrassylic acid; diperoxysebacic acid and diperoxyisophthalic acid;

(vii) 2-decyldiperoxybutane-1,4-dioic acid;

(viii) 4,4'-sulfonylbisperoxybenzoic acid.

Such bleaching agents are disclosed in U.S. Pat. No. 4,483,781, Hartman, issued Nov. 20, 1984, U.S. Pat. No. 4,634,551 to Burns et al., European Patent Application 0,133,354, Banks et al. published Feb. 20, 1985, and U.S. Pat. No. 4,412,934, Chung et al. issued Nov. 1, 1983. Sources also include 6-nonylamino-6-oxoperoxycaproic acid as described in U.S. Pat. No. 4,634,551, issued Jan. 6, 1987 to Burns et al. Persulfate compounds such as for example OXONE, manufactured commercially by E. I. DuPont de Nemours of Wilmington, Del. can also be employed as a suitable source of peroxymonosulfuric acid.

Particularly preferred peracid compounds are those having the formula:

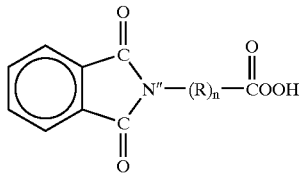

wherein R is $C_{1-4}$ alkyl and n is an integer of from 1 to 5. A particularly preferred peracid has the formula where R is $CH_2$ and n is 5 i.e., phthaloylamino peroxy caproic acid (PAP) as described in U.S. Pat. Nos. 5,487,818, 5,310,934, 5,246,620, 5,279,757 and 5,132,431. PAP is available from Ausimont SpA under the tradename Euroco.

The peracids used herein preferably have a solubility in aqueous liquid compositions measured at 20° C. of from about 10 ppm to about 1500 ppm, more preferably from about 50 ppm to about 1000 ppm, most preferably from about 50 ppm to about 800 ppm solubility is measured at 20° C.

In a particularly preferred embodiment of the present invention the peracid has mean average particle size of less than 100 microns, more preferably less than 80 microns, even more preferably less than 60 microns. Most preferably, when the peracid is PAP, it has a mean average particle size of between about 20 and about 50 microns. The peracid is preferably present at a level of from about 0.1% to about 25%, more preferably from about 0.1% to about 20%, even more preferably from about 1% to about 10%, most preferably from about 2% to about 4%. Alternatively, the peracid may be present at a much higher level of for example 10% to 40%, more preferably from 15% to 30%, most preferably from 15% to 25%.

The bleaching system may comprise photobleaches.

h. Aesthetic Agents

Aesthetic agents may be selected from the group consisting of: colored particles, pearlescent agents, dyes and mixtures thereof.

i. Defoaming agents

Another optional ingredient is a suds suppressor, exemplified by silicones, and silica-silicone mixtures. Examples of suitable suds suppressors are disclosed in U.S. Pat. Nos. 5,707,950 and 5,728,671. These suds suppressors are normally employed at levels of from about 0.001% to about 2% by weight of the composition, preferably from about 0.01% to about 1% by weight.

A preferred defoaming agent is a polydimethylsiloxane compounded with silica.

Liquid Compositions

In one embodiment of the present invention, the liquid compositions of the present invention are not anhydrous, they typically contain up to a major portion of water. For example, the liquid compositions of the present invention may comprise 5% by weight or more of water, more typically from about 5% to about 80% by weight composition of water.

The liquid compositions of the present invention preferably have a pH in 1% water of greater than about 7.2, more preferably greater than 8.

The liquid compositions, when surfactants are present, preferably comprise surfactants that have a combined critical micelle concentration equilibrium surface tension value of less than 15 dynes/cm.

The liquid compositions of the present invention typically comprise lower proportions of organic solvents such as propanediol or other lower alcohols and/or diols, typically comprises from about 0.1% to about 25% by weight of the composition of water Highly preferred compositions herein, unlike shampoos, are low-foaming, either through the specific addition of a suds suppressor, e.g., silica, PDMS, PDMS/silica dispersions and/or or fatty acid, or through intrinsic selection of a low-foaming cleaning system.

In one embodiment, the liquid compositions of the present invention are essentially free lipid skin moisturizing agents, and gel forming polymers which are typically used in personal care compositions and/or shampoos. In other words, the liquid compositions of the present invention do not encompass shampoo and personal care compositions.

Liquid compositions according to the present invention can also be in a "concentrated form", in such case, the liquid compositions according the present invention will contain a lower amount of water, compared to conventional liquid detergents. Typically the water content of the concentrated liquid composition is preferably less than 40%, more preferably less than 30%, most preferably less than 20% by weight of the liquid composition.

In a preferred embodiment, a water-containing liquid detergent composition comprising:

a) a fabric substantive agent having limited solubility in said liquid detergent composition;

b) a crystalline, hydroxyl-containing stabilizer; and optionally, c) a nonsurfactant adjunct suitable for laundry or dishwashing detergents wherein said adjunct is soluble in said liquid detergent composition is provided.

In another embodiment, a water-containing liquid detergent composition comprising:

a) a defoaming and/or aesthetic agent having limited solubility in said liquid detergent composition;

b) a crystalline, hydroxyl-containing stabilizer; and optionally, c) a nonsurfactant adjunct suitable for laundry or dishwashing detergents wherein said adjunct is soluble in said liquid detergent composition is provided.

In yet another embodiment, an aqueous, heavy-duty laundry detergent comprising:

at least 5% water, preferably at least 20% water;

5% to 40% of a surfactant system comprising anionic, nonionic or mixed anionic/nonionic surfactants, optionally including amine oxides;

from 0.1% to 5% of a crystalline, hydroxyl-containing stabilizer;

from at least about 0.01% to about 5% of detersive enzymes;

from 0.1% to 10% of a fabric-substantive agent selected from silicones having all of a cationically charged moiety, a silicon-containing moiety and a polyoxyalkylene moiety;

said composition having a pH at 1% in water of at least 7.5 is provided.

Preferred Non-surfactant Adjuncts

Preferred non-surfactant adjuncts include, but are not limited to, builders, enzymes, enzyme stabilizing systems, chelants, dye transfer agents, dispersants, non-fabric substantive perfumes, filler salts, hydrotropes, photoactivators, hydrolyzable surfactants, perservatives, anti-oxidants, anti-shrinkage agents, anti-wrinkle agents, germicides, fungicides, silvercare, anti-tarnish and/or anti-corrosion agents, alkalinity sources, solubilizing agents, carriers, processing aids, pigments and pH control agents as described in U.S. Pat. Nos. 5,705,464, 5,710,115, 5,698,504, 5,695,679, 5,686,014 and 5,646,101, enzymes being a highly preferred non-surfactant adjunct, for incorporation into the liquid compositions of the present invention.

Enzymes

Liquid compositions of the present invention may further comprise one or more enzymes which provide cleaning performance benefits. Said enzymes include enzymes selected from cellulases, hemicellulases, peroxidases, proteases, gluco-amylases, amylases, lipases, cutinases, pectinases, xylanases, reductases, oxidases, phenoloxidases, lipoxygenases, ligninases, pullulanases, tannases, pentosanases, malanases, β-glucanases, arabinosidases, mannanases, xyloglucanases or mixtures thereof. A preferred combination is a liquid composition having a cocktail of conventional applicable enzymes like protease, amylase, lipase, cutinase, mannanases, xyloglucanases and/or cellulase. Enzymes when present in the compositions, at from about 0.0001% to about 5% of active enzyme by weight of the liquid composition.

Commercially available proteases useful in the present invention are known as ESPERASE®, ALCALASE®, DURAZYM®, SAVINASE®, EVERLASE® and KANNASE® all from Novo Nordisk A/S of Denmark, and as MAXATASE®, MAXACAL®, PROPERASE® and MAXAPEM® all from Genencor International (formerly Gist-Brocades of The Netherlands).

Protease enzymes may be incorporated into the compositions in accordance with the present invention at a level of from about 0.0001% to about 2% active enzyme by weight of the composition.

Examples of commercial α-amylases products are Purafect Ox Am® from Genencor and Termamyl®, Ban®, Fungamyl® and Duramyl®, all available from Novo Nordisk A/S Denmark. WO95/26397 describes other suitable amylases: α-amylases characterised by having a specific activity at least 25% higher than the specific activity of Termamyl® at a temperature range of 25° C. to 55° C. and at a pH value in the range of 8 to 10, measured by the Phadebas® α-amylase activity assay. Suitable are variants of the above enzymes, described in WO96/23873 (Novo Nordisk). Other amylolytic enzymes with improved properties with respect to the activity level and the combination of thermostability and a higher activity level are described in WO95/35382.

The compositions of the present invention may also comprise a mannanase enzyme. Preferably, the mannanase is selected from the group consisting of: three mannans-degrading enzymes: EC3.2.1.25: β-mannosidase, EC3.2.1.78: Endo-1,4-β-mannosidase, referred therein after as "mannanase" and EC3.2.1.100: 1,4-β-mannobiosidase and mixtures thereof. (IUPAC Classification-Enzyme nomenclature, 1992 ISBN 0-12-227165-3 Academic Press).

More preferably, the compositions of the present invention, when a mannanase is present, comprise a β-1,4-Mannosidase (E.C. 3.2.1.78) referred to as Mannanase. The term "mannanase" or "galactomannanase" denotes a mannanase enzyme defined according to the art as officially being named mannan endo-1,4-beta-mannosidase and having the alternative names beta-mannanase and endo-1,4-mannanase and catalysing the reaction: random hydrolysis of 1,4-beta-D-mannosidic linkages in mannans, galactomannans, glucomannans, and galactoglucomannans.

In particular, Mannanases (EC3.2.1.78) constitute a group of polysaccharases which degrade mannans and denote enzymes which are capable of cleaving polyose chains contaning mannose units, i.e. are capable of cleaving glycosidic bonds in mannans, glucomannans, galactomannans and galactogluco-mannans. Mannans are polysaccharides having a backbone composed of β-1,4-linked mannose; glucomannans are polysaccharides having a backbone or more or less regularly alternating β-1,4 linked mannose and glucose; galactomannans and galactoglucomannans are mannans and glucomannans with α-1,6 linked galactose sidebranches. These compounds may be acetylated.

Methods of Laundry

The liquid compositions of the present invention may be used in any step of an in-home laundering/fabric care process, such as through the wash or through the rinse in a conventional laundering process for finished garments, pre-wash or post-wash processes for finished garments, pre-wear or post-wear processes for finished garments.

Product with Instructions for Use

The present invention also encompasses the inclusion of instructions on the use of the liquid compositions of the present invention with the packages containing the compositions herein or with other forms of advertising associated with the sale or use of the compositions. The instructions may be included in any manner typically used by consumer product manufacturing or supply companies. Examples include providing instructions on a label attached to the container holding the composition; on a sheet either attached to the container or accompanying it when purchased; or in advertisements, demonstrations, and/or other written or oral instructions which may be connected to the purchase or use of the compositions.

Specifically the instructions will include a description of the use of the composition, for instance, the recommended amount of composition to use in a washing machine to clean the fabric; the recommended amount of composition to apply to the fabric; if soaking or rubbing is appropriate.

The compositions of the present invention are preferably included in a product. The product preferably comprises a liquid composition in accordance with the present invention, and further comprises instructions for using the product to launder fabrics by contacting a fabric in need of treatment with an effective amount of the composition such that the composition imparts one or more desired fabric care benefits to the fabric.

The following examples are illustrative of the present invention, but are not meant to limit or otherwise define its scope. All parts, percentages and ratios used herein are expressed as percent weight unless otherwise specified.

EXAMPLE

Example I

A stabilized liquid composition in accordance with the present invention is prepared as follows:

Example

| Example<br>Ingredients | % |
|---|---|
| MIX 1 | |
| water | 28.13 |
| Alkyl dimethylamine oxide | 5 |
| monoethanolamine (MEA) | 7 |

-continued

| Example Ingredients | % |
|---|---|
| MEA Borate | 2 |
| Citric acid | 6 |
| phosphoric acid, (1-hydroxyethylidene) bis | 0.45 |
| diethylenetriaminepentakis (methylenephosphonic acid) disodium salt | 0.4 |
| CaCl2 | 0.02 |
| Thixcin R | 1 |
| MIX 2 | |
| water | |
| propylene glycol | 23 |
| cyclohexane dimethanol | 2 |
| Neodol 23-5 | 15 |
| Nonionic EO7 | 2 |
| polyethoxylated hexamethylene methylchloride diquat | 2 |
| Lutensol PE-20, PEI-ethoxylate | 1 |
| polydimethylsiloxan, diquaternary | 5 |

Mix 1 is heated till 90 C. prior to the addition of the Thixcin R. After Thixcin R has been added, the mixture is left at 90 C., under agitation, until all Thixcin R has been emulsified.

After full emulsification of the Thixcin R, the mixture is flash cooled to 70 C. and left at this temperature just until all Thixcin R is recrystallized. At that point, the mixture is allowed to cool down slowly to ambient temperature.

As a next step, mix 2 is added slowly to the premix 1 under slow agitation.

Finished Product Rheology:

| | |
|---|---|
| low shear viscosity (0.001/s) | 308000 cP |
| pour viscosity (21/s) | 320 cP |

Example II

A liquid composition in accordance with the present invention is prepared as follows:

Part 1:

| Ingredient | % by wt |
|---|---|
| Part 1: | |
| HLAS | 15.0000 |
| Nonionic EO7 lutensol | 12.0000 |
| Amine Oxide | 0.5000 |
| Citric Acid | 3.4000 |
| DTPK Fatty Acid | 5.7000 |
| Protease | 0.7400 |
| Duramyl | 0.1370 |
| Termamyl | 0.0720 |
| Ca C12 | 0.0200 |
| Ethoxylated Tetraethylene-Pentaimine | 0.9000 |
| Polyethyleneimine (MW 600) ethoxylated and average of 20 times per nitrogen | 0.7000 |
| FWA-49 | 0.1370 |
| Catalase | 0.4500 |
| Propanediol | 11.5000 |
| Na CS | 5.0000 |
| Acid Blue 80 | 0.0025 |

-continued

| Ingredient | % by wt |
|---|---|
| Cleansafe Opt.5 | 0.9300 |
| Sodium Hydroxide | 2.8500 |
| Kalium Hydroxide | 3.0000 |
| Sodium meta borate | 2.0000 |
| Carbitol | 1.1000 |
| Structuring System of the Present Invention | 0.15 |
| Water | 33.7115 |
| | 100.0000 |

Part 2:

| Ingredient | % by wt. |
|---|---|
| Part 2: | |
| PAP | 10.0000 |
| Polymeric Stabilization System (see U.S. Pat. No. 4,968,451) | 0.8000 |
| HEDP | 7.5000 |
| Sodium Hydroxide | 3.0500 |
| TMBA | 0.2000 |
| Xanthan Gum | 0.5000 |
| H2O2 | 2.0000 |
| Water | 75.9500 |
| | 100.0000 |

Part 1 and Part 2 may be present together within a single compartment, or preferably are present in separate compartments within the same package.

Example III

A liquid composition in accordance with the present invention is prepared as follows:

Part 1:

| Ingredient | % by wt |
|---|---|
| Part 1: | |
| HLAS | 15.0000 |
| Nonionic EO7 lutensol | 12.0000 |
| Amine Oxide | 0.5000 |
| Citric Acid | 3.4000 |
| DTPK Fatty Acid | 5.7000 |
| Protease | 0.7400 |
| Duramyl | 0.1370 |
| Termamyl | 0.0720 |
| Ca C12 | 0.0200 |
| Ethoxylated Tetraethylene-Pentaimine | 0.9000 |
| Polyethyleneimine (MW 600) ethoxylated and average of 20 times per nitrogen | 0.7000 |
| FWA-49 | 0.1370 |
| Catalase | 0.4500 |
| Propanediol | 11.5000 |
| NaCS | 5.0000 |
| Acid Blue 80 | 0.0025 |
| Cleansafe Opt.5 | 0.9300 |
| Sodium Hydroxide | 2.8500 |
| Kalium Hydroxide | 3.0000 |
| Sodium meta borate | 2.0000 |

-continued

| Ingredient | % by wt |
|---|---|
| Carbitol | 1.1000 |
| Structuring System of the Present Invention | 0.15 |
| Water | 33.7115 |
| | 100.0000 |

Part 2:

| Ingredient | % by wt. |
|---|---|
| Part 2: | |
| PAP | 10.0000 |
| Polymeric Stabilization System (see U.S. Pat. No. 4,968,451) | 0.8000 |
| HEDP | 7.5000 |
| Sodium Hydroxide | 3.0500 |
| TMBA | 0.2000 |
| Xanthan Gum | 0.4000 |
| H202 | 2.0000 |
| Water | 76.0500 |
| | 100.0000 |

Part 1 and Part 2 may be present together within a single compartment, or preferably are present in separate compartments within the same package.

What is claimed is:

1. A water-containing heavy duty liquid laundry detergent composition comprising:

a) from 0.1% to 10% of a fabric substantive agent having limited solubility in said liquid detergent composition, wherein the fabric substantive agent is selected from the group consisting of: silicon-moiety containing agents, anti-abrasion polymers, dye fixative agents, optical brighteners, fabric substantive perfumes, soil release polymers, photobleaches, bleaches, bleach precursors, and mixtures thereof;

b) from 0.1% to 10% of a crystalline, hydroxyl-containing stabilizer; and d) 5% to 40% of a surfactant system comprising anionic, nonionic or mixed anionic/nonionic surfactants;

e) wherein said laundry detergent composition has a pH at 1% in water of at least 7.5.

2. The composition according to claim 1 wherein said composition comprises an effective amount of said crystalline, hydroxyl-containing stabilizer to suspend said fabric substantive agent within said composition.

3. The composition according to claim 1 wherein said fabric substantive agent comprises a silicon-containing moiety and is an aminofunctional silicone or quaternary-nitrogen-containing silicone.

4. The composition according to claim 3 wherein said fabric substantive agent is selected from silicone having all of a cationically charged moiety, a silicone-containing moiety and a polyoxyalkylene moiety.

5. The composition according to claim 1 wherein said crystalline, hydroxyl-containing stabilizer comprises a fatty ester or fatty soap moiety.

6. The composition according to claim 1 wherein said crystalline, hydroxyl-containing stabilizer is derived from castor oil.

7. The composition according to claim 1 wherein said crystalline, hydroxyl-containing stabilizer has a formula selected from the group consisting of:

i)

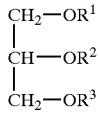

wherein:

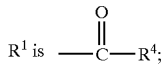

$R^2$ is $R^1$ or H;

$R^3$ is $R^1$ or H;

$R^4$ is independently $C_{10}$–$C_{22}$ alkyl or alkenyl comprising at least one hydroxyl group;

ii)

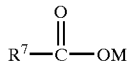

wherein:

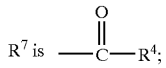

$R^4$ is as defined above in i);

M is $Na^+$, $K^+$, $Mg^{++}$ or $Al^{3+}$, or H; and iii) mixtures thereof.

8. The composition according to claim 1 wherein said crystalline, hydroxyl-containing stabilizer has the formula:

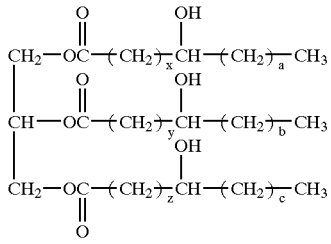

wherein:

(x+a) is from between 11 and 17; (y+b) is from between 11 and 17; and (z+c) is from between 11 and 17.

9. The composition according to claim 8 wherein x=y=z=10.

10. The composition according to claim 8 wherein a=b=c=5.

11. The composition according to claim 1 wherein (i) the anionic surfactant is selected from alkylbenzenesulfonate surfactants, alkyl alkoxylate sulfate surfactants, alkyl sulfate surfactants and mixtures thereof;

(ii) the nonionic surfactant is selected from alkyl alkoxylate surfactants, alkylphenyl alkoxylate surfactants, alkylpolyglycosides, and mixtures thereof, and (iii) mixtures thereof.

12. The liquid laundry detergent composition according to claim 1 further comprising a salt.

13. The liquid laundry detergent composition according to claim 1 further comprising an additional surfactant.

14. A method for providing a benefit to a fabric comprising contacting the fabric with a composition according to claim 1.

15. A liquid laundry detergent composition according to claim 1 wherein the composition comprises a thread-like structuring system having an average aspect ratio of from about 1.5:1, preferably from at least 10:1, to about 200:1.

16. An aqueous, heavy-duty laundry detergent comprising:

at least 5% water, preferably at least 20% water;

5% to 40% of a surfactant system comprising anionic, nonionic or mixed anionic/nonionic surfactants, optionally including amine oxides;

from 0.1% to 5% of a crystalline, hydroxyl-containing stabilizer;

from at least about 0.01% to about 5% of detersive enzymes;

from 0.1% to 10% of a fabric-substantive agent selected from silicones having all of a cationically charged moiety, a silicon-containing moiety and a polyoxyalkylene moiety;

said composition having a pH at 1% in water of at least 7.5.

17. A water-containing heavy duty liquid laundry detergent composition comprising:

a) a fabric substantive agent having limited solubility in said liquid detergent composition;

b) from 0.1% to 5% of a crystalline, hydroxyl-containing stabilizer of the formula:

$$Z—(CH(OH))a\text{-}Z'$$

where a is from 2 to 4; and Z and Z' are hydrophobic groups; and c) a nonsurfactant adjunct suitable for laundry or dishwashing detergents wherein said adjunct is soluble in said liquid detergent composition.

* * * * *